United States Patent [19]

Blakeway

[11] 3,930,346

[45] Jan. 6, 1976

[54] SWIMMING POOL

[75] Inventor: Stanley Richard Blakeway, Brisbane, Australia

[73] Assignee: Eunice Joesphine Blakeway, Stafford, Australia

[22] Filed: Oct. 17, 1974

[21] Appl. No.: 515,679

Related U.S. Application Data

[63] Continuation-in-part of Ser. No. 369,152, June 12, 1973.

[52] U.S. Cl. ..... 52/169; 52/222; 4/172.19

[51] Int. Cl.[2] ..... F04H 3/16

[58] Field of Search ..... 52/169, 222, 86; 4/172.19

[56] References Cited

UNITED STATES PATENTS 2,501,980 3/1950 Wolfe ..... 220/DIG. 25

3,511,002 5/1970 Fox ..... 52/169 X

*Primary Examiner*—Ernest R. Purser
*Assistant Examiner*—Carl D. Friedman
*Attorney, Agent, or Firm*—Donald D. Jeffery

[57] ABSTRACT

An in-ground swimming pool, includes rigid planar ends, a pair of parallel inwardly-extending curved flanges on each said end, the sides and bottom being a sheet of flexible springy sheet material, capable of transportation in rolled form, the edges of said sheet being engaged between said flanges and a highly-compressed gasket of resilient material between said sheet and the inner flange of each said pair.

7 Claims, 8 Drawing Figures

SWIMMING POOL

CROSS REFERENCE TO RELATED APPLICATION

The present application is a continuation-in-part of my application Ser. No. 369,152, filed June 12, 1973.

This invention relates to the formation and assembly of in-ground swimming pools.

It is applicable to prefabrication of such pools and their subsequent assembly on site.

In particular, the invention is applicable to making swimming pools which are transversely curved from edge to edge.

The usual method of making an in-ground swimming pool is to excavate and then construct a reinforced concrete pool in situ in the excavation.

It is one object of this invention to enable an in-ground full size swimming pool to be prefabricated, transported to the site and erected very economically.

In-ground pools are subject to considerable external hydrostatic pressure, particularly when empty, to such an extent that the whole pool has been known to be forced upwards or distorted or cracked by the pressure.

It is a further object of this invention to provide a pool which incorporates means in its structure which automatically relieves such pressure.

It is yet another object to provide a pool in which the sides and bottom of the pool are made of a single integral sheet of material.

In order that the invention may be better understood, exemplary embodiments will be described with reference to the accompanying drawings, in which.

Figure 4:
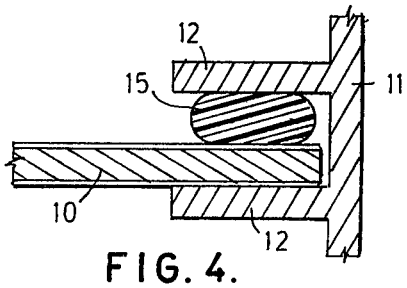
FIG. 4 is a section, further enlarged, on line 4—4 of FIG. 3.
Figure 6:
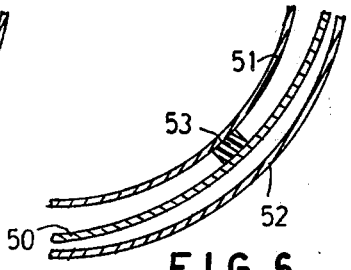
FIG. 6 shows a modification applied to the arrangements of FIG. 5.
Figure 7:
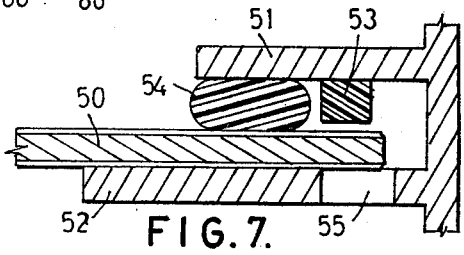

FIG. 7 corresponds to FIG. 4, and but showing the modification of FIG. 6, and

Figure 8:
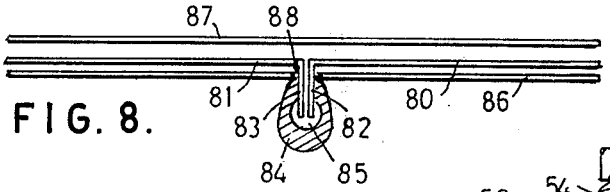

FIG. 8 is a fragmentary, elevational view of a joint formed of adjacently disposed sheets having adjoining flanges.

The parts of the pool are, broadly speaking:

a. A flexible sheet 10 of springy material to form the sides and bottom of the pool.

b. Two planar ends 11 each having on its inner face a pair of curved parallel projections 12 forming a channel there between, and c. means (to be further described below) for sealing the ends of sheet 10 within the channels between projections 12.

The flexible sheet 10 is preferably formed from commercially-available sheet steel of about 18 to 20 gauge, both sides having a decorative wear-resistant surface such as bonded vinyl.

This material is flexible enough to be made into rolls, say, 2–4 feet in diameter. As shown, the material 10 has an angled flange 13 at each end of a roll. As the rolls are used across the pool, these flanges 13 form ledges along each side of the pool.

The end-pieces 11 are planar and may be of strong and rigid material such as fibre-glass or heavy-gauge steel sheet. End-pieces 11 also have flanges (shown at 14). These in the assembled pool form end ledges which abut ledges 13, and so together provide a complete pool surround.

Figure 3:
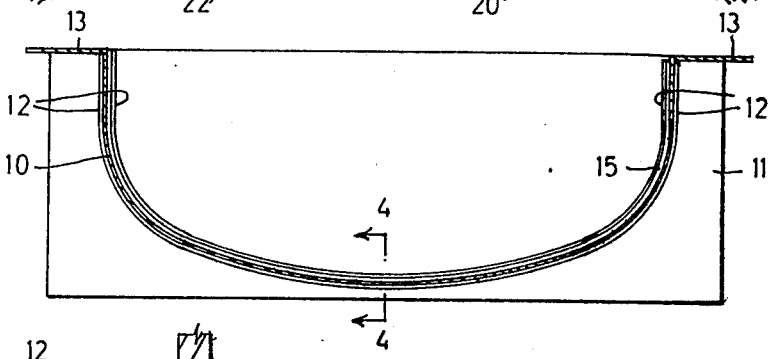
FIG. 3 is a section on line 3—3 of FIG. 1 to enlarged scale.

The projections 12 are also of strong rigid material, such as steel strip, welded to the end piece 11. The projections 12 between them form a narrow channel tracing on each end-piece 11 the cross-sectional shape of the pool (as best shown in FIG. 3).

The edges of sheet 10 are engaged in these channels so that sheet 10 is bent to form the sides and bottom of the pool, while end-pieces 11 form its ends.

In order to seal the joint between sheet 10 and end-pieces 11 against leakage, a resilient circular-section gasket 15 (FIGS. 3 – 4) is highly compressed between sheet 10 and the inner projection 12. It will be noted in FIG. 4 that the end of sheet 10 has a clearance from end-piece 11, so that the resilience of gasket 15 allows some slight movement in the joint, for instance with temperature changes or, more importantly, on distortion of sheet 10 in response to hydrostatic pressure.

The method of assembling a curved structure as described includes the steps of:

a. Placing the planar ends 11 approximately the width of said sheet 10 apart and with the flanges 12 projecting towards each other.

b. Positioning the sheet 10 between said ends 11, and conforming it to engage the curve of flanges 12; and c. Sealing the edges of sheet 10 to flanges 12

Figure 1:
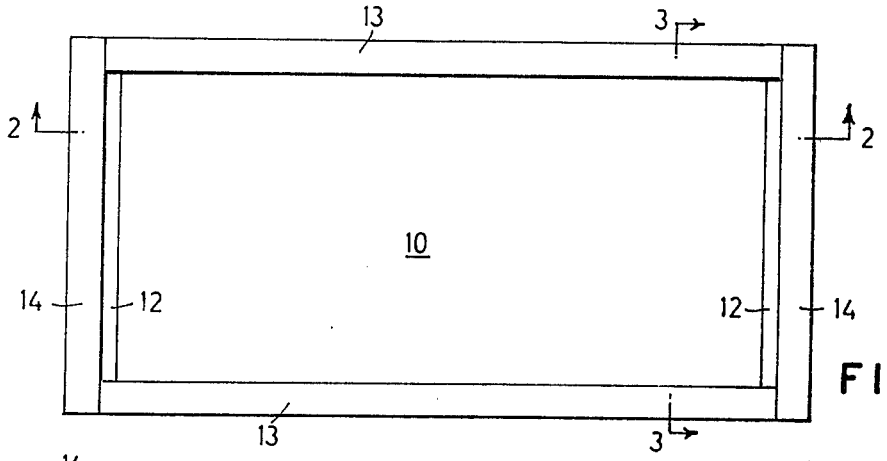
FIG. 1 is a plan view of a swimming pool.
Figure 2:
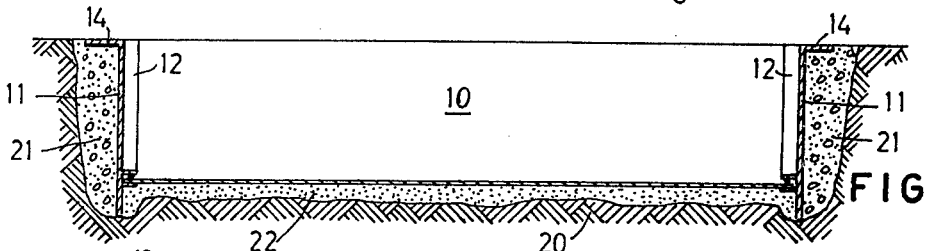
FIG. 2 is a section on line 2—2 of FIG. 1.

In the particular case of an in-ground swimming pool as shown in the drawings, the method of construction may be as follows:

An excavation is made in ground 20 (FIG. 2) somewhat larger than the designed size of the pool and ends.

The rectangular ends 11 are levelled and sheet 10 unrolled between them and engaged between flanges 12 on each, sealing gasket 15 being inserted. Ends 11 are supported by a fill of concrete 21 and sheet 10 by a back-fill of support material 22 such as fine sand, brickies loam or loam-cement mixture. Alternatively, back-fill 22 may be a fill of concrete pumped in from the center-line as the pool fills with water. In this case the sheet 10 may be regarded as a "form" for the concrete, though, of course, it remains in situ.

The side and end surrounds 13, 14 are preferably supported on concrete ledges in any case.

A valuable advantage of the invention is the very small space needed during transportation. The ends 11 can, of course, be shipped flat and take up little space. The sheet 10 may be secured in a roll for shipment. This roll may be as little as 2 feet diameter. Consequently a whole full-size pool may be transported forming only a very small part of a lorry-load. As the roll is not released until on the pool site, it also has the advantage of being able to pass through narrow spaces during approach to the site.

The preferred material for sheet 10 is "Marviplate" (Registered trade mark) which has a thin steel backing with a very flexible and resistant plastic facing.

The ends 11 are preferably of fibre-glass with flanges 12 moulded on them. Alternatively, they may be of relatively heavy steel sheet, the flanges 12 being also of steel edge-welded to the end 11.

Sheet 10 is fairly stiff and consequently when inserted between flanges 12 at a curve will be urged strongly against the inner flange.

Figure 5:
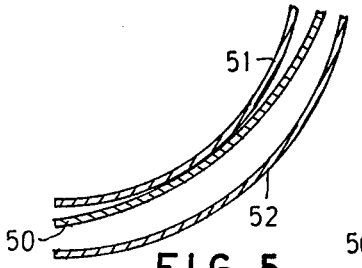
FIG. 5 is an explanatory diagram similar in aspect to part of FIG. 3.

This is illustrated in FIG. 5, where a sheet 50 is inserted between curved inner flange 51 and curved outer flange 52 similar to flanges 12 previously described. This makes it difficult to insert a gasket between sheet 50 and flange 51 at the curve.

Referring to FIG. 6, a block 53, of harder material than a gasket to be used, is inserted during assembly between sheet 50 and inner flange 51. Block 53 keeps sheet 50 and flange 51 spaced apart, allowing a gasket 54 (FIG. 7) to be inserted. As shown in FIG. 7, gasket 54 when fully in place forces sheet 50 and flange 51 further apart, so that block 53 is lifted clear of either sheet 50 (as shown) or of flange 51.

It will also be seen that outer flange 52 in this case is made longer than inner flange 51. Such a construction facilitates the insertion of the edges of sheet 50 between flanges 51, 52.

As explained previously with reference to FIGS. 1 through 4, in assembling a pool, ends 11 carrying the flanges are placed apart and the sheet is confirmed to the curve of the flanges and inserted.

With the projecting flange 52 of FIG. 7 this is made easier by resting sheet 50 on the outer projecting part of flange 52 so that on moving end 11 to the left, sheet 50 is automatically guided between the flanges.

It will be noted that in all embodiments described the gasket is placed between the edge of sheet 10 or 50 and the inner flange 12 or 51. If hydrostatic pressure builds up beneath the pool therefore, this pressure has access via the unsealed gap between the edge of the sheet and the outer flange to the inner end of the channel between the flanges.

This pressure is therefore exerted on the inner side of the gasket and, if it rises unduly, forces the gasket out from between the flanges, rather than damaging the pool. The gasket can, of course, be easily replaced when the pressure is relieved.

In order to allow freer access of the pressure to the inner end of the channel, the outer flange 12 or 52 may be apertured at intervals as indicated at 55 in FIG. 7.

For large pools, it may be desirable to use sheet sections joined together to form a composite sheet. FIG. 8 shows one means for making such joins.

Sheet sections 80, 81 are bent to form flanges 82, 83 respectively which are hammered into the groove in an extruded elongated fastener 84 having a central bore 85, which gives some springiness to the arms of the fastener, and into which, if necessary, a sealing compound can be forced. The edges of sheet sections 80, 81 are inserted as before between flanges 86, 87 corresponding to flanges 12 of FIGS. 1 through 4 or flanges 51, 52 of FIGS. 6 and 7. A slot 88 is formed in outer flange 86 to accommodate flanges 82, 83 and fastener 84, slot 88 also serving as a pressure-access aperture equivalent to 55 in FIG. 7.

What I claim is:

1. An in-ground swimming pool including a pair of rigid substantially planar end members; an inner and an outer arcuate flange projecting from each said end member and defining a channel between them having the shape of the bottom and sides of the pool; a sheet of flexible springy material capable of transportation in rolled form, each lateral edge of said sheet being engaged in one said channel, said edge having a clearance from said end member, thereby to form the sides and bottom of the pool; and a resilient sealing gasket inserted in highly compressed condition between each lateral edge of said sheet and the adjacent inner flange, said gasket being the sole sealing means between said edge and the channel.

2. A swimming pool as claimed in claim 1, in which each said outer flange is wider than said inner flange and projects beyond it.

3. A swimming pool as claimed in claim 1, including at least one aperture in each said outer flange communicating with said channel between said gasket and said end member.

4. A swimming pool as claimed in claim 1, including a spacer between said sheet and said inner flange at a curved portion of said channel, said spacer being of material less compressible than that of said gasket and being of less radial width than said highly-compressed gasket.

5. A swimming pool as claimed in claim 1, in which said sheet is formed of a plurality of longitudinally-extending sections; contiguous flanges on adjacent edges of said sections; a longitudinal fastener having a body, a longitudinal bore in said body and a longitudinal slot through said body leading to said bore, said contiguous flanges being engaged in said slot.

6. A swimming pool as claimed in claim 5, including slots in each said outer flange through which slot said fastener projects.

7. An in-ground swimming pool comprising:

a. a pair of substantially planar end members spaced so as to define the length of said pool, each of said ends including inner and outer spaced parallel flanges defining a channel between them having a predetermined shape of the bottom and side walls of said pool, b. a sheet of flexible springy material capable of being transported in roll form, the lateral edges of said sheet being engaged in said channels when said sheet is rolled out thereby to form the sides and bottom of said pool, clearances being provided between the edges of said sheet and said end members thereby permitting lateral movement of said sheet relative to said end members in response to hydrostatic pressure on said sheet, temperature changes or earth movements and c. a resilient sealing gasket inserted in highly compressed condition between each lateral edge of said sheet and the corresponding inner flange, said gasket being the sole sealing means between said edge and said channel.

* * * * *